US006112048A

United States Patent [19]

Westhoff

[11] Patent Number: 6,112,048

[45] Date of Patent: Aug. 29, 2000

[54] APPARATUS FOR CURLING MATERIALS

[75] Inventor: Daniel J. Westhoff, Georgetown, Ky.

[73] Assignee: Lexmark International, Inc., Lexington, Ky.

[21] Appl. No.: 09/394,028

[22] Filed: Sep. 10, 1999

[51] Int. Cl.[7] ..... G03G 21/00; B31B 1/36

[52] U.S. Cl. ..... 399/406

[58] Field of Search ..... 399/16, 23, 406; 162/270, 271; 271/161, 188, 209; 493/459

[56] References Cited

U.S. PATENT DOCUMENTS

| | | | |
|---|---|---|---|
| 2,012,953 | 9/1935 | Brunner et al. | 92/70 |
| 2,531,619 | 11/1950 | Gonia | 92/70 |
| 4,060,236 | 11/1977 | Carstedt | 271/188 X |
| 4,505,695 | 3/1985 | Billings | 493/459 |
| 4,539,072 | 9/1985 | Frye et al. | 162/197 |
| 4,924,275 | 5/1990 | Nelson | 355/319 |
| 5,009,749 | 4/1991 | Cederholm et al. | 162/271 |
| 5,060,025 | 10/1991 | Kummel et al. | 355/319 |
| 5,066,984 | 11/1991 | Coombs | 355/309 |
| 5,191,379 | 3/1993 | Manzer et al. | 355/282 |
| 5,316,539 | 5/1994 | Leemhuis et al. | 493/459 |
| 5,515,152 | 5/1996 | Kuo | 399/406 |
| 5,539,511 | 7/1996 | Wenthe, Jr. et al. | 355/309 |
| 5,565,971 | 10/1996 | Kuo et al. | 399/406 |
| 5,933,697 | 8/1999 | Onodera et al. | 399/406 |

FOREIGN PATENT DOCUMENTS 60-97163 5/1985 Japan .

OTHER PUBLICATIONS

U.S. Ser. No. 09/393,571, Embry et al., filed Sep. 10, 1999.

U.S. Ser. No. 09/393,244, Leemhuis et al., filed Sep. 10, 1999.

*Primary Examiner*—Quana M. Grainger

*Attorney, Agent, or Firm*—John A. Brady

[57] ABSTRACT

An apparatus for straightening material includes a first guide surface and a second guide surface spaced from the first guide surface. As the material is passed along the first guide surface and along the second guide surface, the first guide surface induces a first curl in the material and the second guide surface induces a second curl in the material. The amount of the first curl may be in proportion to the rigidity of the material to be straightened, and the direction of the first curl may be opposite to that of the second curl.

9 Claims, 4 Drawing Sheets

APPARATUS FOR CURLING MATERIALS

BACKGROUND OF THE INVENTION

1. Field of the Invention

This invention relates to printers and, more particularly, to an apparatus for curling materials, such as paper, used in such printers.

2. Description of the Related Art

Many materials, such as paper, become curled after bending and/or heating. Paper may also become curled after one side of the paper undergoes a printing process. Electrophotographic imaging (i.e., laser printing) typically involves bonding toner to a sheet of paper using heat. This application of heat, or "fusing," often results in significant curling of the paper. This curling can cause problems in subsequent processing, such as wrinkled paper and paper jams in a laser printer.

This curling problem is reduced by straightening the paper. The paper is straightened by actually curling the paper in an opposite direction. If, for example, the paper curls toward a printed side of the page, the paper can be straightened by curling the paper toward the blank side. Thus the paper is straightened by actually curling the paper.

This concept, of curling paper to straighten paper, is used in laser printers. After the laser printer heats the toner and bonds an image to the paper, the high heat, as mentioned above, can cause the paper to curl. Laser printers use a curling operation to straighten the paper and to reduce the problems associated with the high heat of the fusing process.

Previous curling operations, however, only compensate for one direction of curl. After the image is formed, for example, light weight paper generally curls toward the unprinted, blank side of the paper. Heavy weight paper, on the other hand, generally curls toward the printed side of the paper. Because the printed side of a page is often referred to as the "positive" side, heavy weight paper is said to generally have a "positive" curl after leaving the printing process. Light weight paper curls toward the blank side, so light weight paper is said to generally have a "negative" curl after leaving the printing process. Because previous curling operations are effective for only one direction of curl, they cannot completely straighten the various weights of paper commonly used in a laser printer.

U.S. Pat. No. 5,316,539 to Leemhuis et al., issued May 31, 1994, is an example of these previous curling operations. The apparatus disclosed in this patent is only capable of curling in one direction. Any paper requiring a curling operation in an opposite direction is not adequately straightened, and this paper can cause paper jams and other problems.

There is, accordingly, a need in the art for an apparatus which is capable of curling both positive and negative curled papers.

SUMMARY OF THE INVENTION

The aforementioned problems are resolved by an apparatus for straightening material as described herein. The apparatus includes a first guide surface and a second guide surface spaced from the first guide surface. As the material is sequentially passed along the first guide surface and along the second guide surface, the first guide surface induces a first curl in the material and the second guide surface induces a second curl in the material. The first curl may be in proportion to the rigidity of the material to be straightened, and the first curl may be opposite in direction to the second curl.

BRIEF DESCRIPTION OF THE DRAWINGS

These and other features, aspects, and advantages of the present invention will be better understood when the following Detailed Description is read with reference to the accompanying drawings wherein.

DETAILED DESCRIPTION

Figure 1:
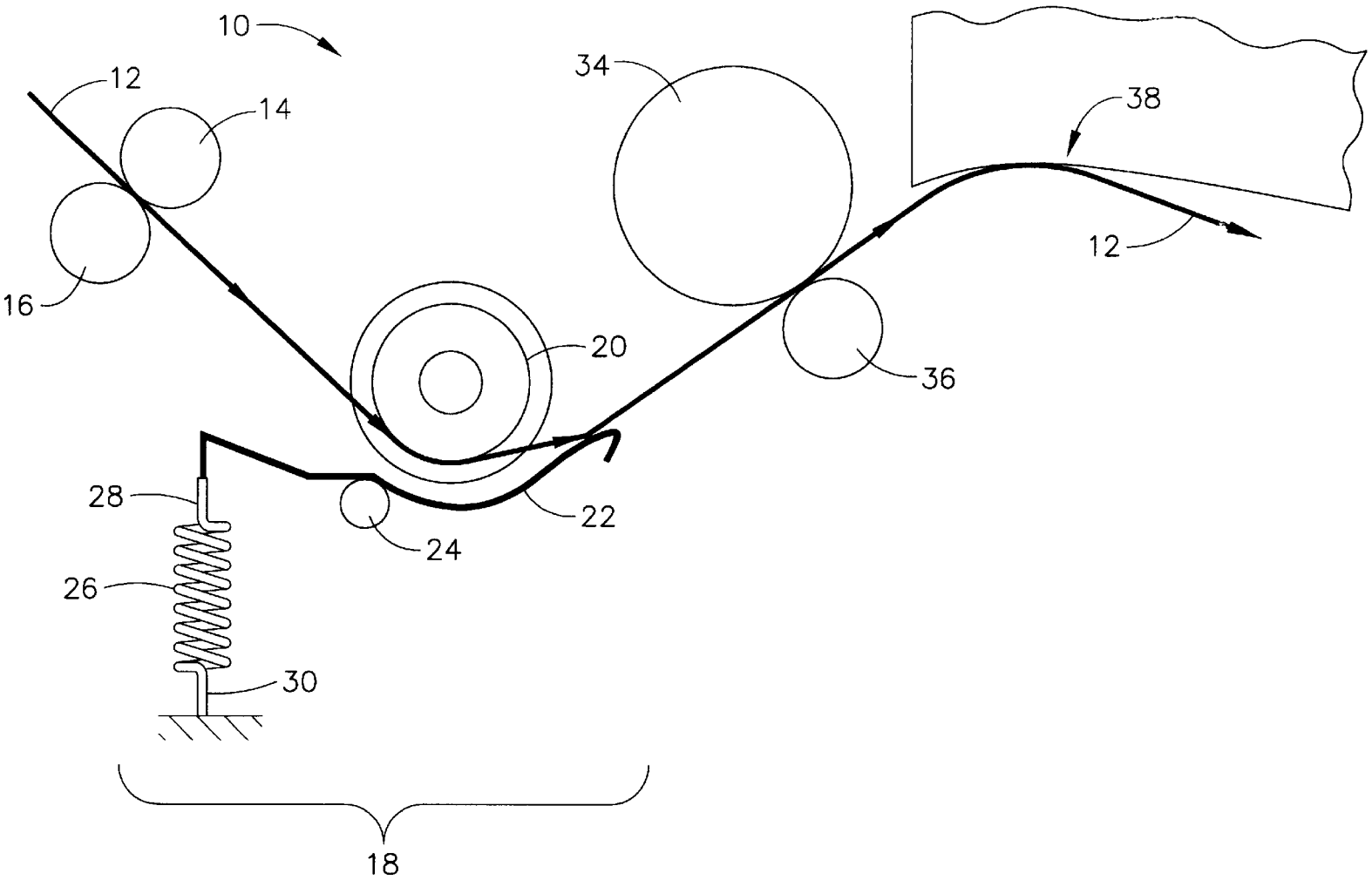
FIG. 1 is a perspective side view of an apparatus for straightening paper according to one embodiment of the present invention.

FIG. 1 is a perspective side view of an apparatus 10 for straightening paper according to one embodiment of the present invention. Paper 12 is fed between pinch rollers 14 and 16. The pinch rollers 14 and 16 feed the paper into a compensating bend mechanism 18. The compensating bend mechanism includes a roller 20 and a curl guide 22 positioned opposite the roller 20. Means for pivoting the curl guide is included, as the curl guide 22 is shown mounted on a pin 24 and pivoting about the pin. Means for biasing the curl guide 22 toward the roller 20 is also included, with FIG. 1 showing a spring 26 biasing the curl guide. A first end 28 of the spring 26 is attached to the curl guide 22. A second end 30 of the spring 26 is attached to a stationary point of the apparatus. As paper 12 contacts the curl guide, the curl guide pivots about the pin and biases the spring. As the paper 12 exits the curl guide 22, the paper enters a drive roller 34 and an idler roller 36. The rollers 34 and 36 drive the paper into a recurl channel 38.

The compensating bend mechanism 18 is similar to that shown and discussed in U.S. Pat. No. 5,316,539 to Leemhuis et al., granted May 31, 1994, and in concurrently filed U.S. application Ser. No. 09/393,570 to Embry et al., which are each incorporated herein by reference.

The curl guide 22 is designed to straighten lighter weight paper. As the paper passes along the curl guide 22, the curl guide creates a first guide surface. This first guide surface induces a first curl in the paper. Because, however, the curl guide 22 is biased by the spring 26, the first curl is proportional to the rigidity of the paper. Lighter weight paper, such as 16# (international measure 60 g/m$^2$) paper, lacks rigidity to pivot the curl guide 22 and to bias the spring 26, so lighter weight paper is curled and straightened.

Heavy weight paper, on the other hand, is only minimally curled by the curl guide 22. Heavy weight paper, such as 90# (international measure 338 g/m$^2$) paper, has enough rigidity to pivot the curl guide 22 and to bias the spring 26. As heavy weight paper passes along the curl guide, and thus the first guide surface, the compensating bend mechanism 18 compensates for the rigidity and only induces a small amount of curl in heavy weight paper.

This compensation for rigidity is important. The weight of the paper determines the direction that the paper will curl when leaving the fusing process of a laser printer. After an image is printed on the paper, light weight paper generally curls toward the unprinted, blank side of the paper. Heavy weight paper, on the other hand, generally curls toward the printed side of the paper. Because the printed side of a page is often referred to as the "positive" side, heavy weight paper is said to generally have a "positive" curl after leaving the fusing process. Light weight paper curls toward the blank side, so light weight paper is said to generally have a "negative" curl after leaving the fusing process. The compensating bend mechanism 18 thus corrects the negative curl generally found in light weight paper, yet, the compensating bend mechanism has little effect on the positive curl found in heavy weight paper.

Figure 2:
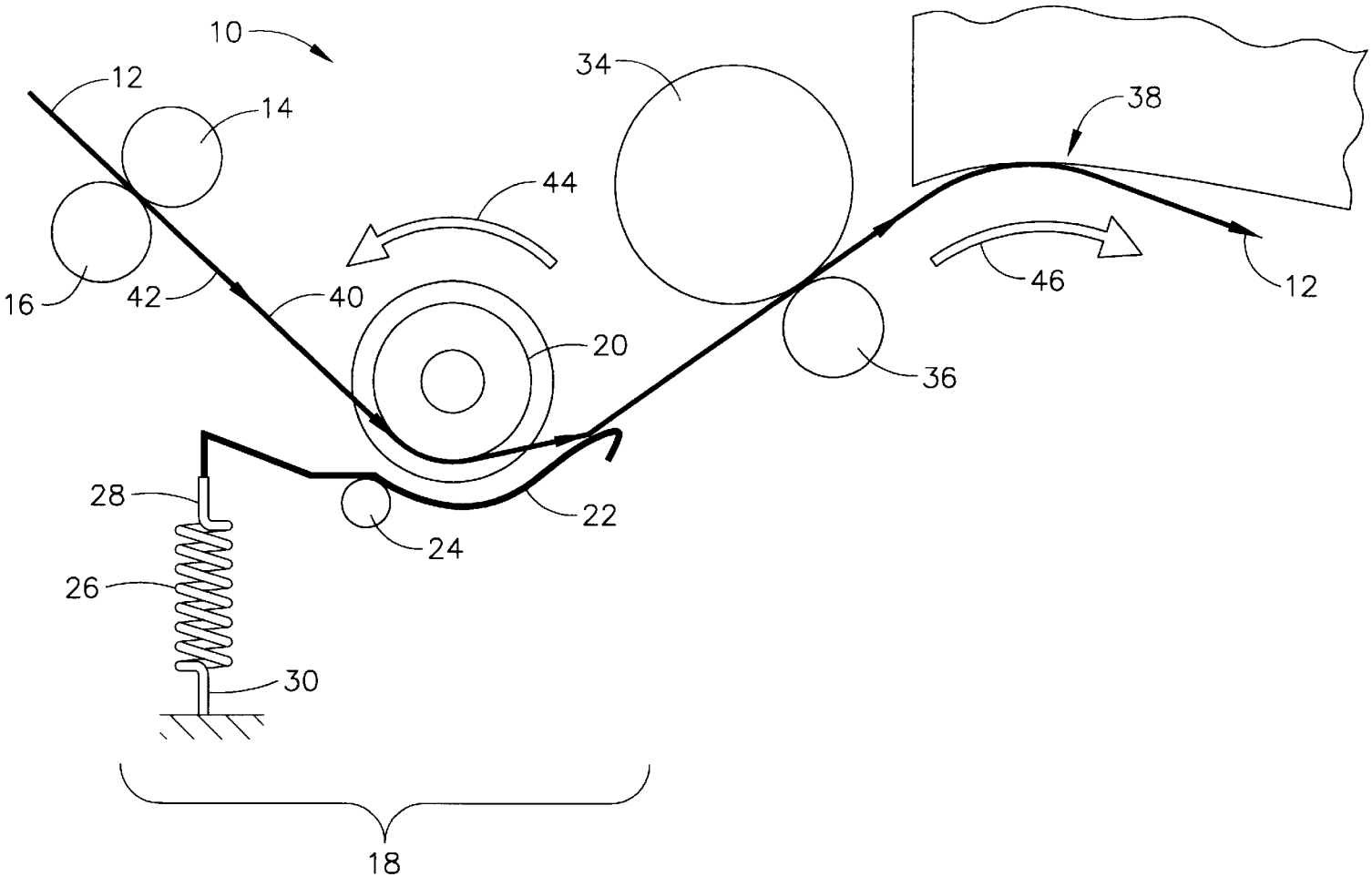
FIG. 2 is also a perspective side view of an apparatus for straightening paper.

The positive and negative curl induced by the apparatus 10 may be better understood when viewing FIG. 2. As FIG. 2 shows, the paper 12 travels through the compensating recurl mechanism 18 with a printed side 40 facing upward and a blank side 42 facing downward. The compensating recurl mechanism 18 induces a positive curl in the paper. This positive curl is in a counterclockwise direction as shown by arrow 44. Because the paper travels through the compensating recurl mechanism with the printed side 40 facing upward, the negative curl generally found in light weight paper is corrected by the positive curl induced by the curl guide 22. Heavy weight paper, already having a positive curl after leaving the fusing process, is largely unaffected by the positive curl of the compensating recurl mechanism.

The positive curl of heavy weight paper is corrected by the recurl channel 38. The recurl channel induces a negative curl in the paper. This negative curl is in a clockwise direction as shown by arrow 46. As the rollers 34 and 36 feed the paper into the recurl channel 38, the positive curl generally found in heavy weight paper is corrected by the negative curl induced by the recurl channel.

The recurl channel, however, has little effect on light weight paper. The recurl channel has a large radius of curvature to correct the positive curl found in heavy weight paper, yet the curvature is too large to induce a curl in light weight paper. For example, a radius of curvature of about forty millimeters (40 mm) is adequate to induce a negative curl in heavy weight paper, yet this curvature is too large to affect light weight paper. Further testing shows a radius of curvature of about fifteen millimeters (15 mm) starts to have an effect on light weight paper. The preferred embodiment would probably have a radius of curvature of about twenty five millimeters (25 mm), although those skilled in the art readily recognize the radius of curvature may be altered to suit a particular application. Furthermore, those so skilled will also recognize the compensating recurl mechanism and the recurl channel may both be altered to suit a particular application.

The recurl channel 38 can be any structure that produces the desired negative curl. FIGS. 1 and 2 show the recurl channel 38 as a sidewall of a channel. This channel guides the paper toward subsequent processing steps. The recurl channel may, alternatively, be any continuous surface that produces the desired negative curl. The recurl channel may even be composed of multiple segments (such as ribs) that produce the desired curl. The recurl mechanism may also utilize a moveable roller, for example, positioned in contact with the recurl channel to provide the negative curl. Those skilled in the art will recognize there are many structural alternatives to creating any desired curl.

The apparatus, alternatively, may be defined as three surfaces. The roller 20 provides a first guide surface, the curl guide 22 provides a second guide surface, and the recurl channel 38 provides a third guide surface. The curl guide 22 is positioned opposite the roller's first guide surface, and as the material, such as paper, is passed between the first guide surface and the second guide surface, the second guide surface induces a first curl in the material. The recurl channel's third guide surface also receives the material and induces a second curl in the material. The first curl may be proportional to the rigidity of the material, and the first curl may be opposite to the second curl.

Figure 3:
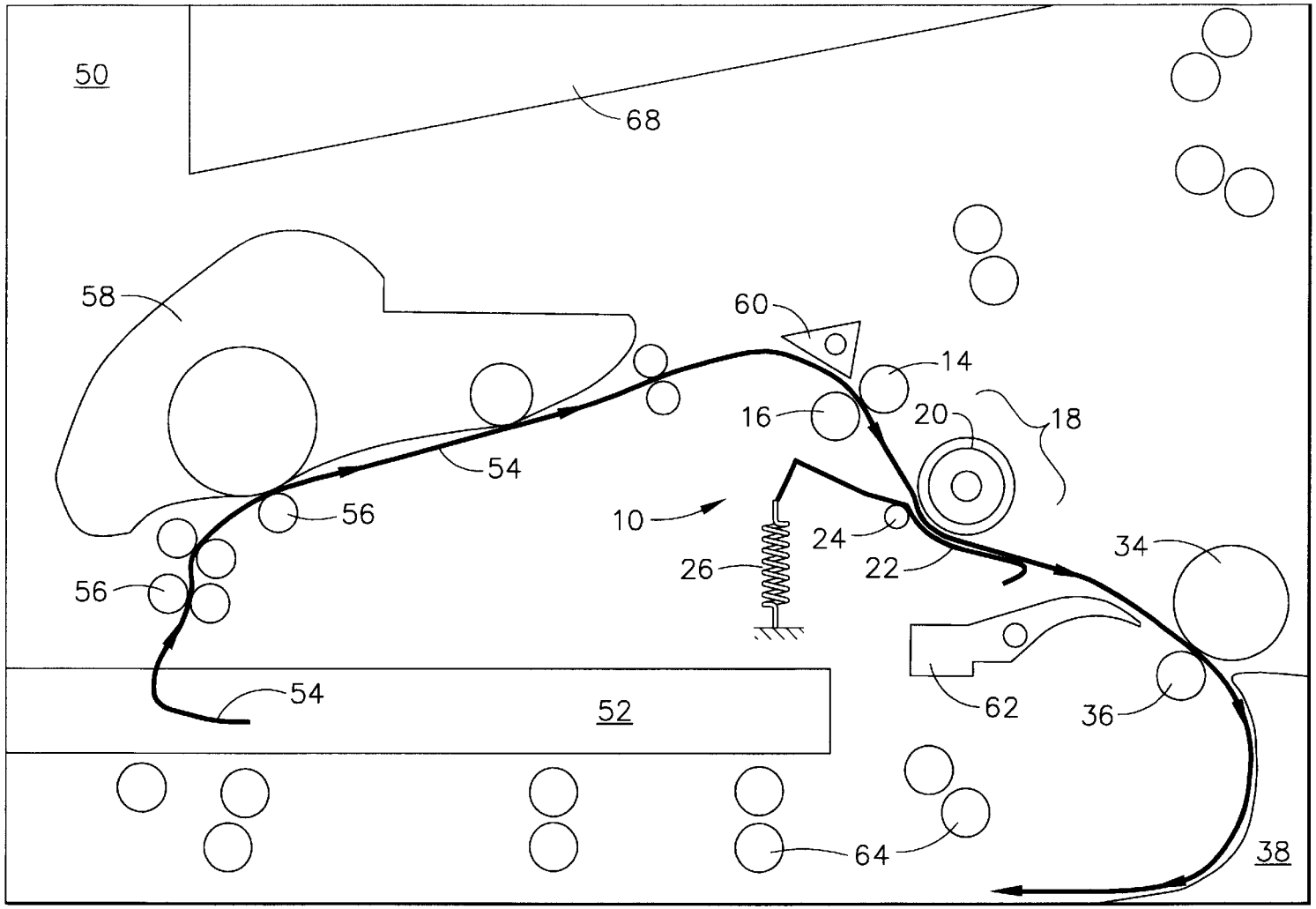
FIGS. 3 and 4 show the apparatus of FIGS. 1 and 2 operating in an electro-photographic printer.

FIGS. 3 shows the apparatus of FIGS. 1 and 2 operating in an electrophotographic printer, such as that manufactured by LEXMARK™ of Lexington, Ky. The apparatus 10 is shown enlarged for clarity. The printer 50 includes a paper supply 52 containing at least one sheet of paper 54. The paper supply is typically a cassette tray contained in a lower portion of the printer. An input system 56 feeds the paper to a print engine 58. The print engine is responsible for writing, transferring, and fusing an image on the paper as is conventionally known in the art. The heat of the print engine causes the paper to curl, so the paper is fed into the apparatus for curling paper 10.

In this example, the apparatus for curling paper 10 is positioned within a duplexing paper path. This duplexing paper path is chosen when the paper is to be printed on each side. If course, the apparatus for curling paper 10 does not have to be used in the duplexing paper path. It can, for example, be positioned in the redrive portion of the paper path between the fuser exit and the printer exit. In FIG. 3, a first diverter gate 60 directs the paper from the print engine 58 and into the apparatus 10. The sheet of paper 54 is fed between the pinch rollers 14 and 16. The pinch rollers 14 and 16 feed the paper into the compensating bend mechanism 18. As the paper 54 contacts the curl guide 22, the curl guide pivots about the pin 24 and biases the spring 26. As the paper 54 exits the curl guide 22, the paper contacts a second diverter gate 62. This second diverter gate directs the paper into the drive roller 34 and into the idler roller 36. The rollers 34 and 36 drive the paper into the recurl channel 38.

The recurl channel 38, as mentioned before, induces a negative curl in heavy weight paper. This negative curl corrects the positive curl generally found in heavy weight paper. The recurl channel, however, has little effect on light weight paper. The paper travels along the surface of the recurl channel 38 until the paper clears the second diverter gate 62. When the paper clears the second diverter gate, the pinch rollers 34 and 36 stop driving the paper and gravity flips the second diverter gate upward.

Figure 4:
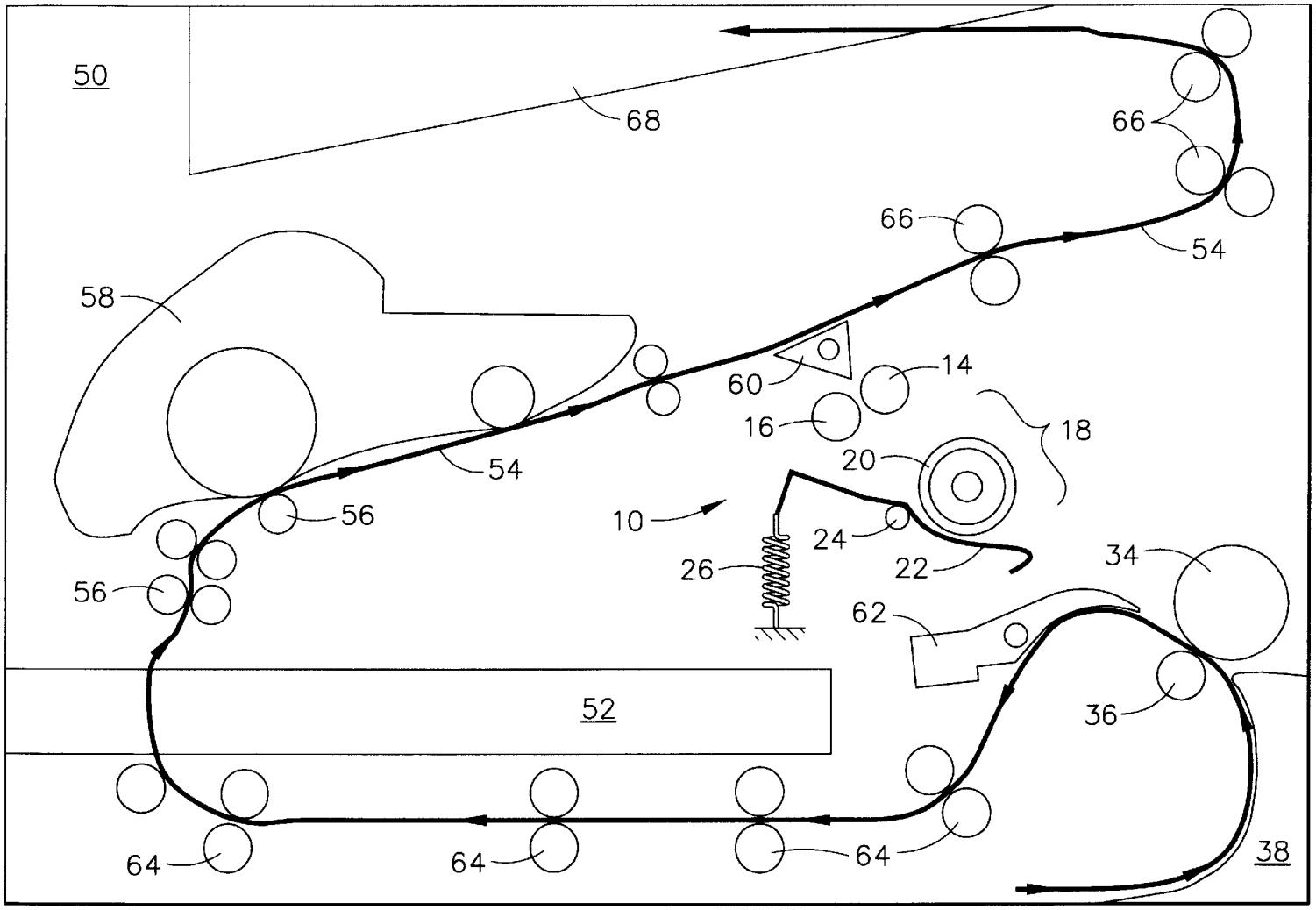

FIG. 4 shows the duplexing path once the paper clears the second diverter gate. When the second diverter gate 62 flips upward, the rollers 34 and 36 reverse direction. The rollers 34 and 36 now drive the paper into the second diverter gate 62. The diverter gate directs the paper into a system of duplexer rollers 64. These duplexer rollers 64 direct the paper back into the input system 56. The input system delivers the paper 54, with an unprinted side now facing upward, into the print engine 58. The paper now has an image fused onto each side of the paper, and the paper is once again directed into the first diverter gate 60. Because duplexing is no longer required, the first diverter gate 60 directs the paper into an output system 66. The curled, straightened sheet of paper is then delivered to an output tray 68.

While the apparatus is described for use in straightening paper, those skilled in the art will recognize the apparatus (or variations of the apparatus) may also be used to straighten non-paper materials such as steels, polymers, wood pulps and wood fibers, silks, and cottons.

Those skilled in the art will readily recognize the compensating recurl mechanism may be interchanged with the recurl channel. For example, although FIG. 1 shows the paper first entering the compensating recurl mechanism, those skilled in the art recognize the apparatus may be designed such that the paper first enters the recurl channel. Thus, although the paper is sequentially passed along the guide surfaces, the term "sequentially" as used herein is used only to mean that one guide surface is contacted after another guide surface. The order that the paper traverses the guide surfaces is not critical.

Although the recurl channel is described as inducing a negative curl, those skilled in the art readily recognize the recurl channel may induce a positive curl. The curl guide, likewise, may be alternatively designed to induce a positive curl. Those skilled in the art will recognize the apparatus may be configured to induce any combination of curl as an application may require.

While the present invention has been described with respect to various features, aspects, and embodiments, those skilled and unskilled in the art will recognize the invention is not so limited. Other variations, modifications, and alternative embodiments may be made without departing from the spirit and scope of the present invention.

What is claimed is:

1. An apparatus for straightening material, the apparatus comprising:

a first guide surface; and a second guide surface spaced from the first guide surface such that when the material is passed along the first guide surface and along the second guide surface, the first guide surface induces a first curl in the material and the second guide surface induces a second curl in the material;

one of said first guide surface and said second guide surface inducing minimal curl in heavy weight paper; and the other of said first guide surface and said second guide surface inducing minimal curl in light weight paper.

2. An apparatus for straightening material according to claim 1, wherein said one guide surface is said first guide surface and the amount of the first curl is in proportion to the rigidity of the material to be straightened.

3. An apparatus for straightening material according to claim 1, wherein the direction of the first curl is opposite to the direction of the second curl.

4. An apparatus for straightening material, the apparatus comprising:

a first guide surface;

a second guide surface opposite the first guide surface such that when the material is passed between the first guide surface and the second guide surface the second guide surface induces a first curl in light weight paper and a minimal curl in heavy weight paper; and a third guide surface receiving the material such that when the material is passed along the third guide surface, the third guide surface induces a second curl in heavy weight paper.

5. An apparatus for straightening material according to claim 4, wherein the amount of the first curl is in proportion to the rigidity of the material to be straightened.

6. An apparatus for straightening material according to claim 4, wherein the direction of the first curl is opposite to the direction of the second curl.

7. An electrophotographic printer for printing an image on a sheet of paper, the printer comprising:

an input system;

a print engine for producing the image on the sheet of paper, the input system delivering the sheet of paper to print engine;

an apparatus for straightening paper, the apparatus including a first guide surface and a second guide surface, the second guide surface spaced from the first guide surface; and wherein when the paper is passed along the first guide surface and along the second guide surface, one of said first guide surface and said second guide surface induces minimal curl in heavy weight paper and straightening curl in light weight paper, and the other of said first guide surface and said second guide surface induces minimal curl in light weight paper and straightening curl in heavy weight paper.

8. An electrophotographic printer according to claim 7, wherein the amount of the curl of said one guide surface is in proportion to the rigidity of the paper to be straightened.

9. An electrophotographic printer according to claim 7, wherein the direction of the curl of said first guide surface is opposite to the direction of the curl of said second guide surface.

* * * * *